US007530179B2

(12) United States Patent
Rocheleau

(10) Patent No.: US 7,530,179 B2
(45) Date of Patent: May 12, 2009

(54) STEP AIR FOIL

(75) Inventor: Michael O. Rocheleau, Sobieski, WI (US)

(73) Assignee: MegTec Systems, Inc., DePere, WI (US)

( * ) Notice: Subject to any disclaimer, the term of this patent is extended or adjusted under 35 U.S.C. 154(b) by 0 days.

(21) Appl. No.: 10/823,299

(22) Filed: Apr. 13, 2004

(65) Prior Publication Data

US 2005/0223593 A1 Oct. 13, 2005

(51) Int. Cl.
*F26B 13/00* (2006.01)

(52) U.S. Cl. ..... 34/640; 34/641; 242/615.11; 226/97.3

(58) Field of Classification Search ..... 34/638, 34/640, 641, 643; 242/615.11; 226/97.3
See application file for complete search history.

(56) References Cited

U.S. PATENT DOCUMENTS

| | | | | |
|---|---|---|---|---|
| 3,384,282 A | | 5/1968 | Vits | 226/97 |
| 3,587,177 A | | 6/1971 | Overly et al. | 34/156 |
| 3,705,676 A | | 12/1972 | Overly et al. | 226/97 |
| 3,763,571 A | * | 10/1973 | Vits | 34/641 |
| 4,074,841 A | | 2/1978 | Kramer et al. | 226/97 |
| 4,308,984 A | * | 1/1982 | Vits | 226/97.3 |
| 4,606,137 A | | 8/1986 | Whipple | 34/156 |
| 4,901,449 A | * | 2/1990 | Wimberger | 34/641 |
| 4,932,140 A | * | 6/1990 | Lepisto | 34/641 |
| 5,797,327 A | | 8/1998 | Gieser et al. | 101/483 |
| 6,325,896 B1 | | 12/2001 | Hultcrantz et al. | 162/289 |
| 6,598,315 B1 | * | 7/2003 | Heikkila et al. | 34/461 |

* cited by examiner

*Primary Examiner*—Kenneth Rinehart
(74) *Attorney, Agent, or Firm*—Nields, Lemack & Frame, LLC

(57) ABSTRACT

Step air foil particularly for one-sided flotation of a running web, and web dryer incorporating the same. The air foil includes two discharge slots which allow for increased draw down force, which flattens machine direction wrinkles in a floating web. The air foil includes a primary discharge slot and a second discharge slot spaced from and stepped down from the primary discharge slot, a first web support surface between the primary discharge slot and the secondary discharge slot, and a second web support surface downstream of the secondary discharge slot in the direction of web travel. The air foil is in communication with an air supply which provides a supply of air that is uniformly distributed to the primary and secondary slots. Air discharged from the primary slot is gathered into the air stream of the secondary slot and creates an increased air cushion to provide greater support to the moving web and thereby remove machine direction web wrinkles caused by higher tension in light weight webs.

14 Claims, 7 Drawing Sheets

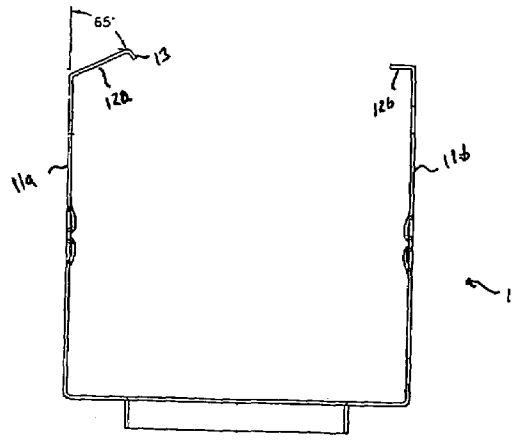
FIG. 2
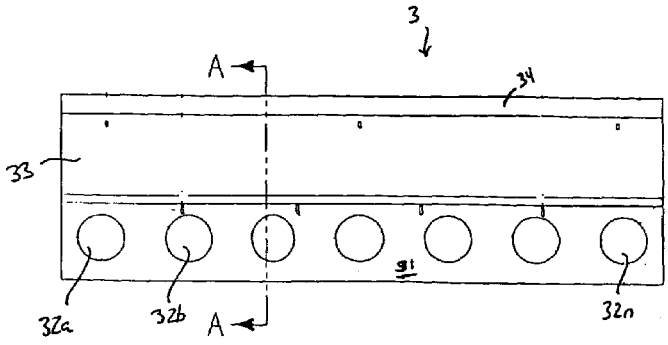
FIG. 3A
FIG. 3B
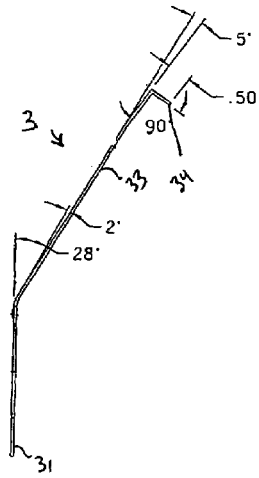

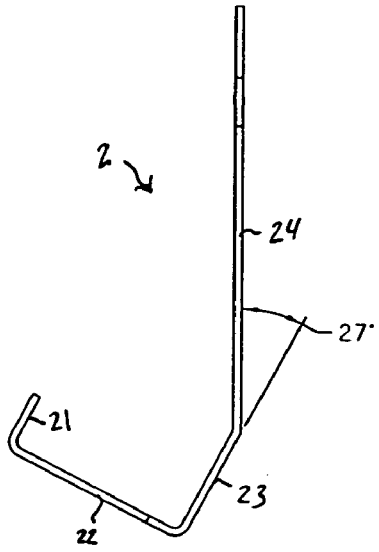
FIG. 4
FIG 5
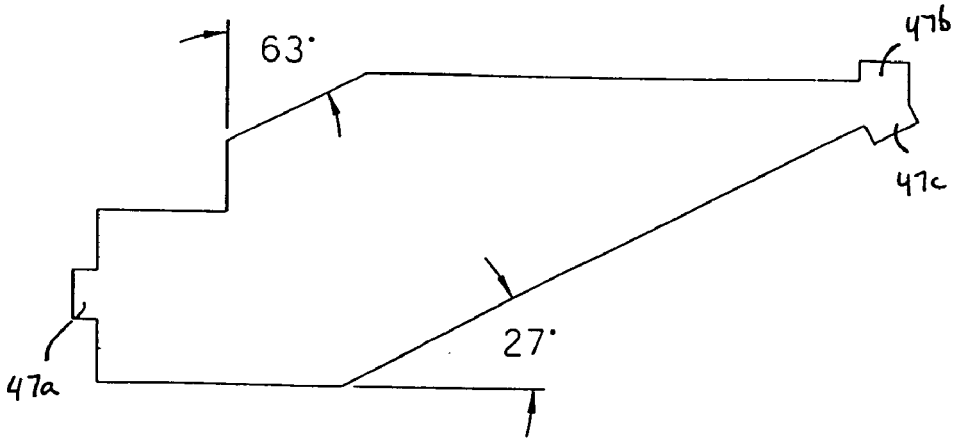

STEP AIR FOIL

FIELD OF THE INVENTION

The present invention relates to devices for contactlessly drying and guiding traveling webs, and more particularly, an improved web air flotation device that minimizes, eliminates or removes web wrinkles.

BACKGROUND OF THE INVENTION

In web coating, printing and drying operations, it is often desirable that the web have contactless support, in order to avoid damage to the web itself or to the coating (such as ink) previously applied to one or more surfaces of the web. One conventional arrangement for contactlessly supporting a web during drying includes horizontal upper and lower sets of air bars between which the web travels. Hot air issuing from the air bars both dries and supports the web as it travels through the dryer.

Important characteristics of any flotation system are the amount of cushioning provided by the flotation device, and the stability of the web as it passes over the device. Adequate support removes web wrinkles that typically are caused by higher tensions in lightweight webs. Airflow instabilities near the web can induce web flutter and subsequent web contact with mechanical parts of the dryer, resulting in coating disturbance or web damage. Web flutter can be manifested in a multitude of forms, ranging from a violent flapping of the web to a high frequency drumming.

Single slot air bars are known in the art as air foils. They differ from double and triple slot air bars in that they have both a positive and negative pressure on the face of the air bar, whereas the double and triple slotted bars have only positive pressure. As a result, double and triple slotted air bars can be operated over a wider range of pressures and clearances; typical flotation clearances of air foils being about 2.3 mm compared to 6.3 mm for double and triple air bars. Air foils also have a dramatic decrease in both heat transfer and flotation stability as clearance is increased, whereas the heat transfers for double and triple air bars are relatively stable up to a clearance of 25 mm (single size bar). A typical application for single slot air bars is where flotation must be accomplished with air on only one side of the web.

Conventional air foils discharge air at about 45° to the web, which pushes the web up and relies on the flatness of the web to trap the air and force it to follow the air foil face. This creates a negative pressure to pull the web back down and hold it in place over the air foil. When floating lightweight webs under medium to high tensions, machine direction corrugations will form in the web. These corrugations allow the discharged air from the 45° slot to escape and not trap the air between the air foil face and the web, thereby reducing or eliminating the velocity created to draw the web down to the air foil face. This can result in poor flotation and can render the air foil ineffective.

It is therefore an object of the present invention to provide an air foil for floating a web that provides excellent web support for a wide range of web weights, and provides excellent web stability.

SUMMARY OF THE INVENTION

The problems of the prior art have been overcome by the present invention, which provides a step air foil particularly for one-sided flotation of a running web, and a web dryer having one or more such air foils. The air foil design includes two discharge slots which allow for increased draw down force, which flattens machine direction wrinkles in a floating web. The design does not rely on a flat web to help create a cross-face velocity to draw the web to the face for proper flotation as in conventional designs. Air discharged from the primary slot is gathered into the air stream of the secondary slot and creates an increased air cushion to provide greater support to the moving web and thereby remove machine direction web wrinkles caused by higher tension in light weight webs. The two air discharge slots blow gas (air) parallel to the web over a longer area than conventional designs thereby increasing the draw down force against the web.

The air foil includes a primary discharge slot and a second discharge slot spaced from and stepped down from the primary discharge slot, a first web support surface between the primary discharge slot and the secondary discharge slot, and a second web support surface downstream of the secondary discharge slot in the direction of web travel. The air foil is in communication with an air supply which provides a supply of air that is uniformly distributed to the primary and secondary slots.

The air foil can be primarily used for one sided flotation, but also can be used with two sided arrangements for enhancement of drying.

BRIEF DESCRIPTION OF THE DRAWINGS

FIG. 2 is a cross-sectional view of the header of the air foil of FIG. 1;

FIG. 3A is a top view of the trailing bottom plate of the air foil of the present invention;

FIG. 3B is a cross-sectional view of the trailing bottom plate taken along line A—A of FIG. 3A;

FIG. 4 is a cross-sectional view of the trailing top plate of the air foil of the present invention;

FIG. 5 is a cross-sectional view of a spacer for the air foil of the present invention;

DETAILED DESCRIPTION OF THE INVENTION

The air foil of the present invention is a unique design that incorporates a secondary slot that discharges air parallel to the web in order to maintain a constant pull down force that is independent of a flat web. It is particularly useful for one-sided flotation applications.

Figure 1:
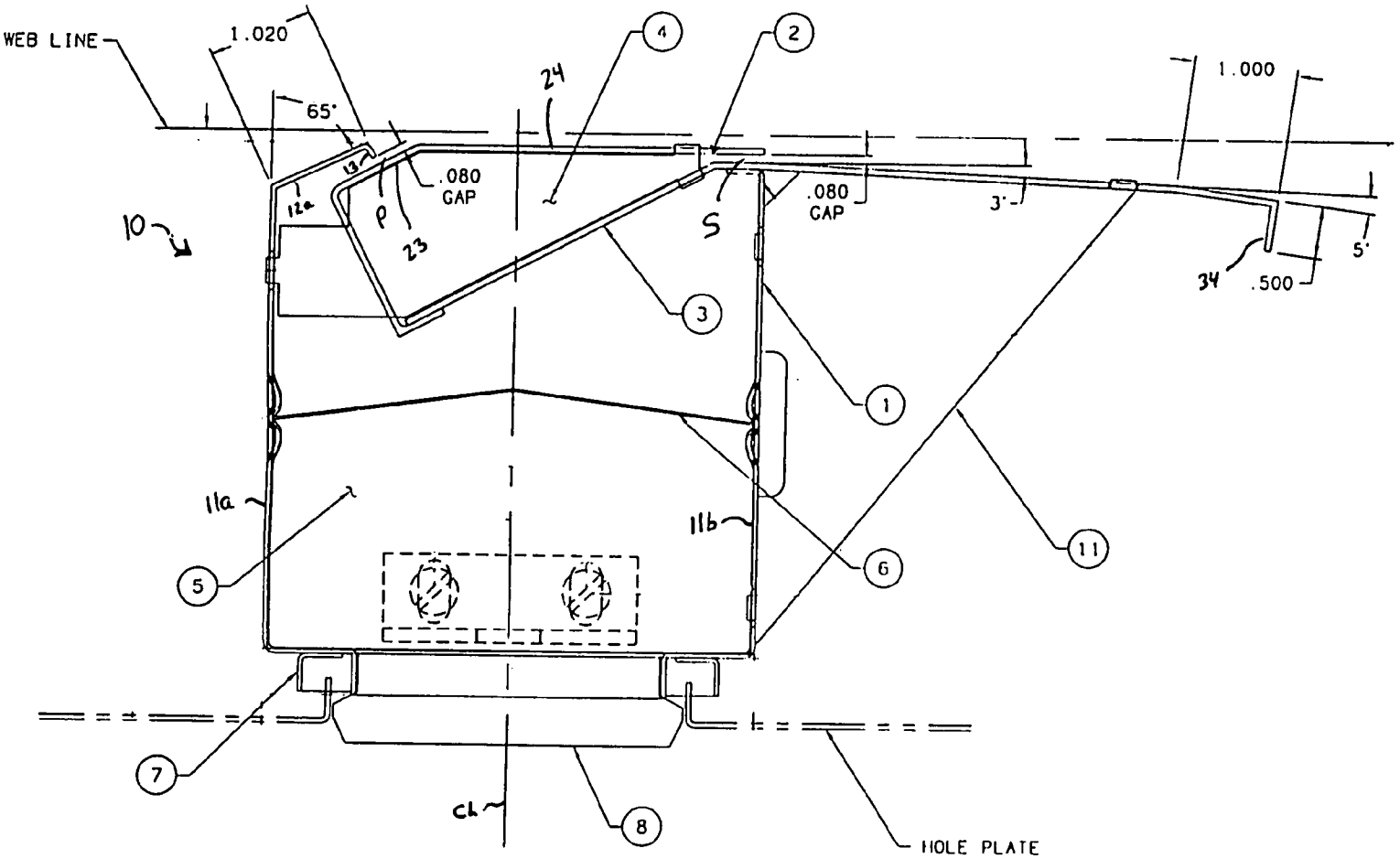
FIG. 1 is a cross-sectional view of an air foil in accordance with the present invention.
Figure 1A:
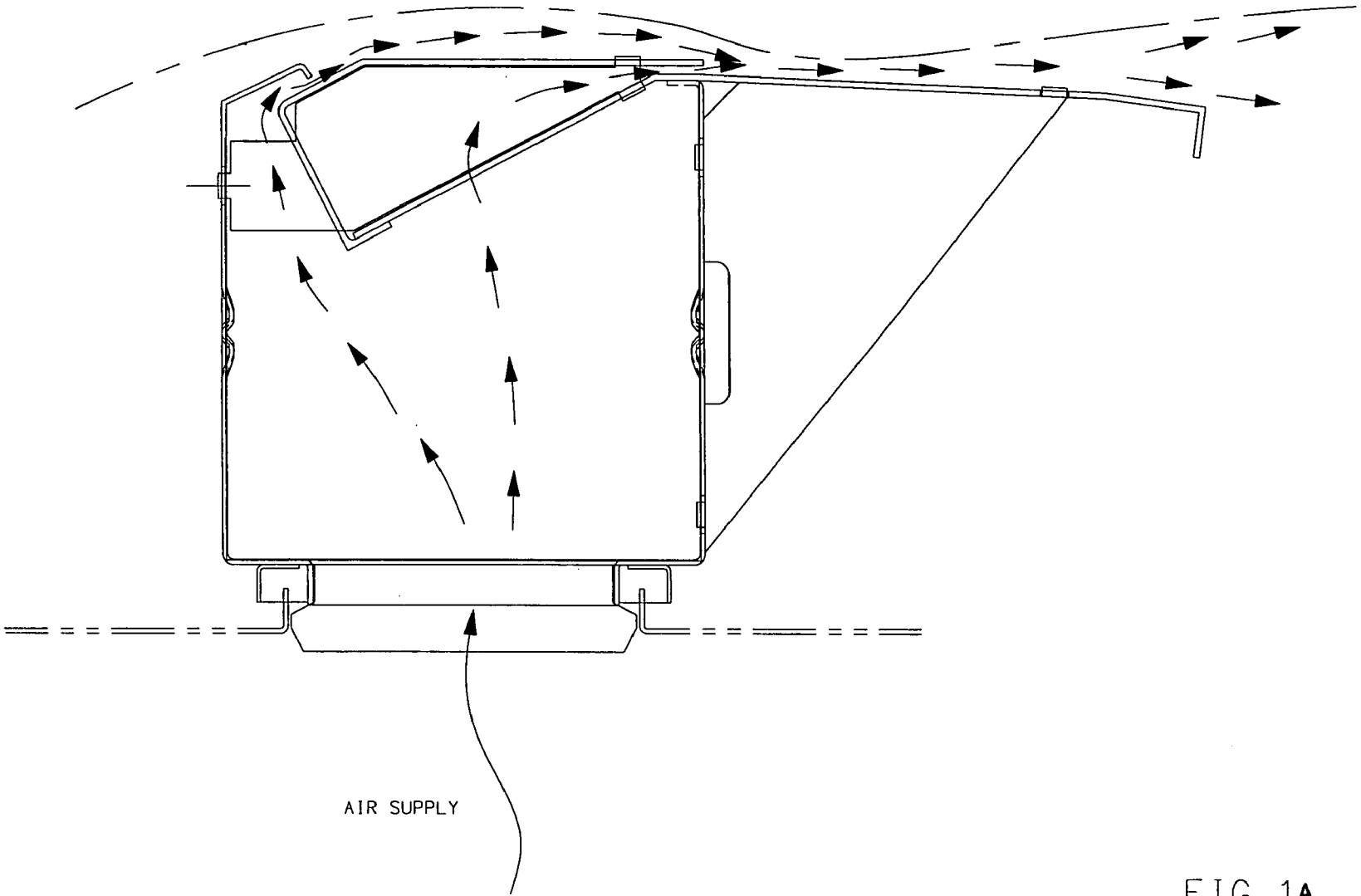
FIG. 1A is a cross-sectional view of an air foil showing the discharge of air in accordance with the present invention.

Turning now to FIG. 1, there is shown an air foil in accordance with the preferred embodiment of the invention generally at 10. The air foil 10 is defined in part by a header 1, which in the embodiment shown, is generally rectangular in cross-section except for its top portion. As seen in FIG. 2, opposite sides 11*a*, 11*b* of header 1 terminate in respective top flange portions 12*a*, 12*b*. Top flange portion 12*a* is angled, preferably at about 65° relative to vertical, and terminates in a bent portion 13. Top flange portion 12*b* extends towards opposite side 11*a* in a substantially horizontal fashion. The header 1 defines an interior space 5 that serves as a plenum for the gas that is received via the one or more holes 36 at the base of the air foil that are in gas-receiving communication with a gas supply (not shown). The header 1 is positioned on suitable ducting by aligning the aligners 8 at each end plate of the header and is sealed by retainer gasket 7. A diffuser plate 6 (FIG. 1) having a plurality of spaced holes can be positioned in the header to help distribute the supply of gas evenly as it flows towards the slots. In the embodiment shown, the diffuser 6 has a pitch (about 15°) with an apex at or near the centerline CL of the header 1.

The flange portions 12*a*, 12*b* and bent portion 13 of header 1, together with the trailing top plate 2 and trailing bottom plate 3, define the primary and secondary slots of the air foil. Specifically, FIGS. 3A and 3B illustrate the trailing bottom plate 3 in greater detail. The plate 3 includes a relatively short portion 31 that has a plurality of spaced apertures 32*a*–32*n* formed therein. Preferably the apertures are circular and are evenly spaced to allow for even flow of gas from the plenum to the stepped-down secondary slot of the air foil, as discussed in greater detail below. In the embodiment shown, there are six such apertures, each about 2 inches in diameter, although those skilled in the art will appreciate that the present invention is not limited to any particular number or size aperture.

Figure 6:
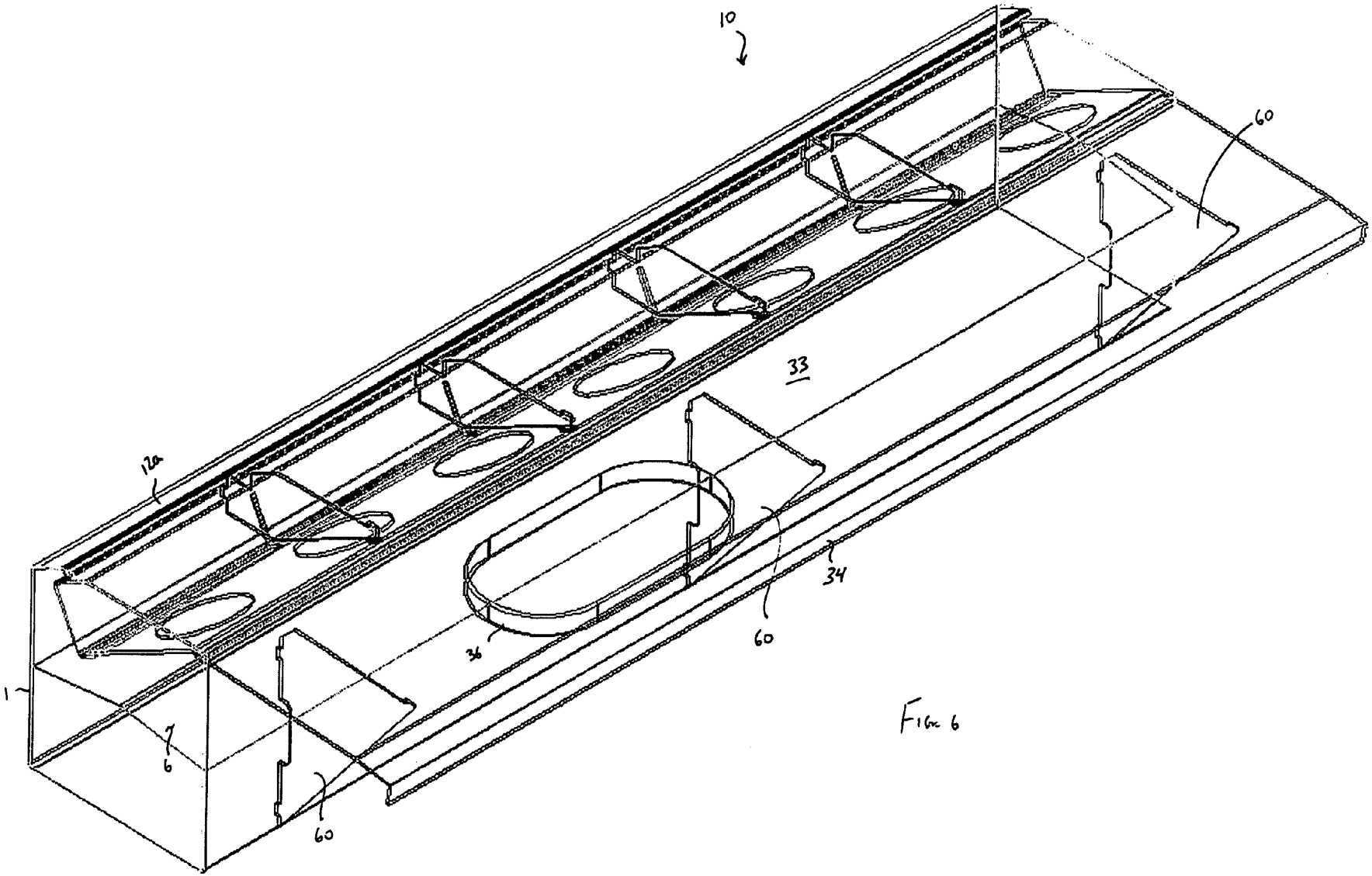
FIG. 6 is a perspective view of the air foil of the present invention.

The plate 3 also includes a relatively long portion 33 that extends from the short portion 31 at an angle therefrom. The relatively long portion 33 forms the wing of the air foil, as best seen in FIG. 6, and terminates in a downwardly extending flange 34. Preferably the relatively long portion 33 of the plate 3 extends from the short portion 31 at an angle of about 28°, bends an additional 2–3° towards the midpoint of the portion 33, and then bends an additional 5° about one inch from the flange 34. The flange 34 extends downwardly at a right angle about 0.5 inches. The plate 3, together with trailing top plate 2, defines the secondary slot S through which air flowing from the apertures 32*a*–32*n* is emitted. That air then travels along the top face of the wing in the direction of web travel.

FIG. 4 illustrates the trailing top plate 2 in cross-section. The top plate 2 includes a flange 21 that connects to the end of the short portion 31 of the trailing bottom plate 3, such as by welding (see FIG. 1). Extending from flange 21 is a first flat portion 22, a second flat portion 23 which extends from flat portion 22 at an angle of approximately 90°, and an elongated portion 24 that extends from second flat portion 23 at an angle of about 27°. When properly positioned in the header 1, the second flat portion 23 of the trailing top plate 3 defines with flange 13 of the header 1 the primary slot P, and the elongated portion 24 defines a top web support face of the air foil 10 (best seen in FIG. 1) along which the air exiting from the primary slot P flows in the direction of web travel. Preferably the discharge opening of the primary slot P is about 0.08 inches.

The distance between the primary slot P and the secondary slot S is important for proper air flow and web flotation. If the distance is too small, the air issuing from the primary slot P will not flow parallel to the web. If the distance is too great, the primary slot airflow will lose its velocity. Preferably the distance between the slots is from about 2.5 inches to about 6.5 inches, with 3.25 inches particularly preferred.

Turning now to FIG. 5, there is shown in cross-section a spacer 4. The spacer 4 is shaped to be received within the space defined by the top and bottom trailing plate assemblies. Preferably a plurality of spacers 4 are positioned along the length of the air foil, and are positioned between the apertures in the trailing bottom plate 3 so as not to interfere with the flow of gas emanating from the apertures 32*a*–32*n*. The spacing across the air foil length is not critical, as they merely form a truss system for strength. The cross-sectional shape of the spacers 4 matches the cross-section of the area defined by the trailing top and bottom plates 2 and 3, respectively. The spacers 4 can be secured in place by any suitable means, and are preferably secured via welding of the tab 47*a* to the header 1, tab 47*b* to the trailing top plate 2, and tab 47*c* to the trailing bottom plate 3. The spacer ends set the gap or opening size for the secondary slot S, which is preferably about 0.08 inches. The secondary slot S discharges air parallel to the web and maintains a constant air velocity across the flat face for maximum draw down force.

Figure 7:
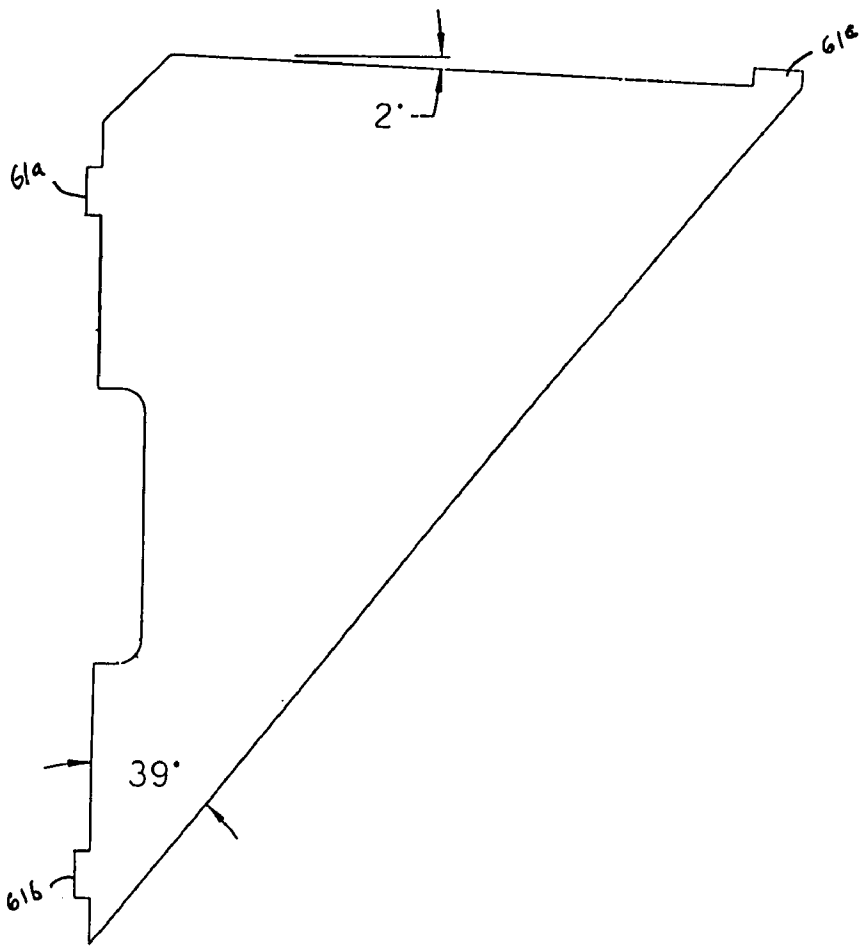
FIG. 7 is a cross-section view of a gusset for the air foil of the present invention.

In order to adequately support the wing extension of the trailing bottom plate, a plurality of gussets 60 (FIG. 7) are positioned beneath the wing as shown in FIG. 6. Each gusset 60 attaches to the header 1 by suitable means, such as by welding at tabs 61*a*, 61*b*. Similarly, the top of the gusset 60 attaches to the underside of the wing via welding of tab 61*c*. The top of each gusset 60 is tapered to accommodate the slope of the wing. The number of gussets needed depends upon the length of the nozzle, and is within the skill in the art. In the embodiment shown in FIG. 6, three evenly spaced gussets are provided.

Figure 8:
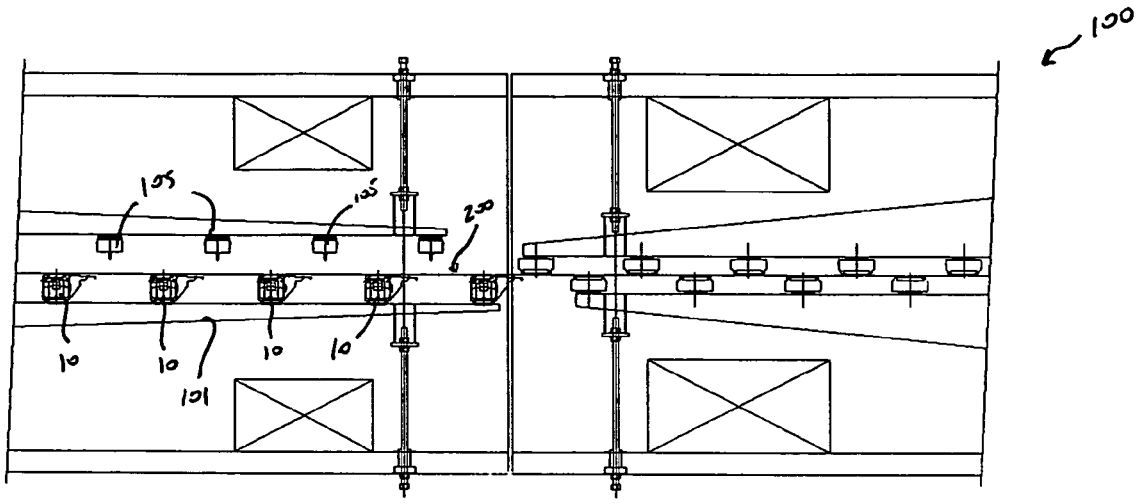
FIG. 8 is a schematic view of a dryer having a plurality of air foils on one side of the web in accordance with an embodiment of the present invention.

As shown in FIG. 8, the two discharge slots allow for effective one-sided web flotation of all weight webs, from thin films to heavier paper and films. A portion 100 of a web dryer is shown, with a plurality of air foils 10, each in communication with an air supply header 101 and positioned on one side of the running web 200. Positioned on the opposite side of the running web 200 is a plurality of nozzles 105, each preferably located in a staggered relationship relative to the location of each air foil 10. In the embodiment shown, the opposing nozzles 105 in the step air foil zone of the dryer 100 are basic single slot nozzles with low velocity and high volume for solvent dillution to keep LFL levels low. A constant cross-face velocity draws the web to the air foil face to produce good flotation and web characteristics. The two-slot design allows for twice the draw down force, which in turn flattens the machine direction wrinkles in a floating web. The increased hold down force of the air foil creates a flat web for a stabile transition into opposing air bar zones without web flutter, web billowing, or marking problems.

Thus, in operation, air flow is discharged through primary and secondary slots or orifices. The design allows for the reclamation of the discharged air from the primary slot to be gathered into the air stream of the secondary slot and create an increased air cushion to give greater support to the moving web, which in turn removes the machine direction web wrinkles caused by higher tensions in lighter weight webs. A higher flotation height (e.g., a positive 0.125 inch flotation height off the air foil face regardless of line speed) is possible for higher tensioned webs. Because air is discharged below and parallel to the web, there is always a velocity across the air foil face to draw the corrugated web down to the face and hold it in place for controlled transport. The increased cushion pressure of the secondary slot stretches the web, removing any machine direction wrinkles that may have formed in the web, thereby creating a glass-like appearance to the web. By incorporating two discharge slots on two different face locations and thus providing two large flat face areas, the draw down force is doubled, which is a necessity when flattening machine direction corrugation wrinkles.

The range of web weights and tension conditions with which the present invention exhibits excellent flotation characteristics is more than twice that of conventional designs.

The performance of the air foil allows for a larger spacing between air foils when installed in a dryer and allows for a greater window of operation with different web weights and web tensions. It can be used as a web-stabilizing device because of the strong web capturing characteristics of the design.

What is claimed is:

1. An air foil for floating a web of material, comprising a primary discharge slot and a secondary discharge slot spaced from and stepped down from said primary discharge slot, said secondary discharge slot being downstream of said primary discharge slot in the direction of web travel, a first flat web support surface between said primary discharge slot and said secondary discharge slot, and a second web support surface downstream of said secondary discharge slot in the direction of web travel, wherein said secondary discharge slot discharges air parallel to the web.

2. An air foil for floating a web of material, comprising a primary discharge slot and a secondary discharge slot spaced from and stepped down from said primary discharge slot, said secondary discharge slot being downstream of said primary discharge slot in the direction of web travel, a first flat web support surface between said primary discharge slot and said secondary discharge slot, and a second web support surface downstream of said secondary discharge slot in the direction of web travel, wherein air discharged from said primary discharge slot is gathered into the air stream of said secondary discharge slot in a direction parallel to the web transport direction.

3. An air foil for floating a web of material, comprising a primary discharge slot and a secondary discharge slot spaced from and stepped down from said primary discharge slot, said secondary discharge slot being downstream of said primary discharge slot in the direction of web travel, a first flat web support surface between said primary discharge slot and said secondary discharge slot, and a second web support surface downstream of said secondary discharge slot in the direction of web travel, wherein said second web support surface comprises a wing portion that slopes downwardly as it extends away from said secondary discharge slot.

4. The air foil of claim 1, 2 or 3, further comprising a diffuser for uniformly distributing air to said primary discharge slot and to said secondary discharge slot.

5. The air foil of claim 1, 2 or 3, wherein said second web surface is an elongated wing having a series of bends.

6. The air foil of claim 5, wherein said elongated wing terminates in a downwardly extending flange.

7. the air foil of claim 5, wherein one of said bends is at an angle of 30°.

8. A web dryer, comprising a web inlet and a web outlet spaced from said web inlet, a plurality of air discharge nozzles in said dryer for drying said web, and at least one air foil in said dryer, said air foil comprising a primary discharge slot and a secondary discharge slot spaced from and stepped down from said primary discharge slot, said secondary discharge slot being downstream of said primary discharge slot in the direction of web travel, a first flat web support surface between said primary discharge slot and said secondary discharge slot, and a second web support surface downstream of said secondary discharge slot in the direction of web travel, wherein said secondary discharge slot discharges air parallel to the web.

9. A web dryer, comprising a web inlet and a web outlet spaced from said web inlet, a plurality of air discharge nozzles in said dryer for drying said web, and at least one air foil in said dryer, said air foil comprising a primary discharge slot and a secondary discharge slot spaced from and stepped down from said primary discharge slot, said secondary discharge slot being downstream of said primary discharge slot in the direction of web travel, a first flat web support surface between said primary discharge slot and said secondary discharge slot, ana a second web support surface downstream of said secondary discharge slot in the direction of web travel, wherein there are a plurality of air foils in said dryer, all positioned on the same side of said web.

10. An air foil for floating a web of material, comprising a primary discharge slot and a secondary discharge slot spaced from and stepped down from said primary discharge slot, a first web support surface between said primary discharge slot and said secondary discharge slot, a second web support surface downstream of said secondary discharge slot in the direction of web travel, said second web support surface comprising a bent plate, wherein said secondary discharge slot is defined by said first web support surface and said bent plate, wherein air discharged from said primary discharge slot is gathered into the air stream of said secondary discharge slot in a direction parallel to the web transport direction.

11. the air foil of claim 10, wherein said bent plate comprises a plurality of apertures to allow air flow to said secondary discharge slot.

12. The air foil of claim 10, wherein said secondary discharge slot discharges air parallel to the web.

13. A web dryer, comprising a web inlet and a web outlet spaced from said web inlet, a plurality of air discharge nozzles in said dryer for drying said web, and at least one air foil in said dryer, said air foil comprising a primary discharge slot and a secondary discharge slot spaced from and stepped down from said primary discharge slot, said secondary discharge slot being downstream of said primary discharge slot in the direction of web travel, a first flat web support surface between said primary discharge slot and said secondary discharge slot, and a second web support surface downstream of said secondary discharge slot in the direction of web travel, wherein air discharged from said primary discharge slot is gathered into the air stream of said secondary discharge slot in a direction parallel to the web transport direction.

14. A web dryer, comprising a web inlet and a web outlet spaced from said web inlet, a plurality of air discharge nozzles in said dryer for drying said web, and at least one air foil in said dryer, said air foil comprising a primary discharge slot and a secondary discharge slot spaced from and stepped down from said primary discharge slot, said secondary discharge slot being downstream of said primary discharge slot in the direction of web travel, a first flat web support surface between said primary discharge slot and said secondary discharge slot, and a second web support surface downstream of said secondary discharge slot in the direction of web travel, wherein said second web support surface comprises a wing portion that slopes downwardly as it extends away from said secondary discharge slot.

* * * * *